United States Patent [19]

Greiner

[11] 4,438,746

[45] Mar. 27, 1984

[54] RPM GOVERNOR FOR A FUEL INJECTION PUMP

[75] Inventor: Max Greiner, Gerlingen, Fed. Rep. of Germany

[73] Assignee: Robert Bosch GmbH, Stuttgart, Fed. Rep. of Germany

[21] Appl. No.: 400,549

[22] Filed: Jul. 21, 1982

[30] Foreign Application Priority Data

Sep. 22, 1981 [DE] Fed. Rep. of Germany ..... 3137520

[51] Int. Cl.[3] ..... F02D 1/04

[52] U.S. Cl. ..... 123/373; 123/503

[58] Field of Search ..... 123/373, 364, 449, 503; 417/289, 294

[56] References Cited

U.S. PATENT DOCUMENTS

| | | | |
|---|---|---|---|
| 3,025,843 | 3/1962 | Wagner et al. | 123/373 |
| 3,791,361 | 2/1974 | Hofmann | 123/373 |
| 3,942,498 | 3/1976 | Eheim et al. | 123/503 |
| 3,945,360 | 3/1976 | Laufer | 123/449 |
| 3,970,066 | 7/1976 | Schmitt et al. | 123/373 |
| 4,180,040 | 12/1979 | Hofer et al. | 123/503 |

FOREIGN PATENT DOCUMENTS

| | | | |
|---|---|---|---|
| 715449 | 11/1941 | Fed. Rep. of Germany | 123/373 |
| 2349663 | 4/1975 | Fed. Rep. of Germany | 123/449 |

OTHER PUBLICATIONS

Adler et al., Bosch, Technical Instruction, Fuel Injection Equipment for Diesel Engines (2) Governors for In-Line Pumps, 9/75, pp. 8, 9, 13.

*Primary Examiner*—Ira S. Lazarus
*Assistant Examiner*—Magdalen Moy
*Attorney, Agent, or Firm*—Edwin E. Greigg

[57] ABSTRACT

An rpm governor of a fuel injection pump for internal combustion engines is proposed. The rpm governor includes a governor spring, which at one end engages a governor lever of the fuel injection pump and at the other end engages a correction lever. The other end of the correction lever is engaged by a correction spring, which is coupled at its other end with an adjusting member secured eccentrically relative to an adjusting shaft on an adjusting lever. The adjusting lever is connected with the adjusting shaft and is variable in its position by means of this shaft. The correction lever is supported between a roller and an adjusting gear wheel, which engages a rack zone of the correction lever. By rotating the adjusting gear wheel, the lever arms associated with the governor spring and the correction spring can be varied, thus varying the resultant spring force or spring constant engaging the governor lever in order to establish the degree of proportionality of the rpm governor.

9 Claims, 2 Drawing Figures

RPM GOVERNOR FOR A FUEL INJECTION PUMP

BACKGROUND OF THE INVENTION

The rpm governor is based on an rpm governor of a fuel injection pump for internal combustion engines having a governor lever which is pivotable about a shaft and arranged to actuate a supply quantity adjusting member of the fuel injection pump, the governor lever being engaged counter to an rpm-dependent force by a governor spring embodied as a tension spring. An rpm governor is already known in which the degree of proportionality in mass production, because of manufacturing tolerances for the governor parts (that is, flyweights, governor spring, installation tolerances, etc.), is ±1.5%. However, there are fields of application in which the degree of proportionality has to be within far narrower limits, such as ±0.5%. The degree of proportionality is the P- degree which indicates how high the rpm of a diesel engine during speed regulation increases from the rated rpm at full load to the upper idling rpm. The P-degree is usually indicated in percent of the rpm increase up to the upper full-load rpm. The P degree has been set forth in the following publication:

BOSCH, "Technical Instruction, Fuel Injection Equipment for Diesel Engines (2) Governors for In-Line Pumps". Copyright Robert Bosch GmbH (1975), Editor-in-Chief Ulrich Adler, Translation (1977) John T. Warner, Michael J. Scott, 1st edition Sept. 1975, pages 8, 9, 13.

OBJECT AND SUMMARY OF THE INVENTION

The rpm governor according to the invention intended for a fuel injection pump as revealed hereinafter has the advantage over the prior art that the degree of proportionality is not only adjustable, but can also be kept quite small to meet the above requirements.

Advantageous further embodiments of and improvements to the rpm governor disclosed in the application will be understood by a careful perusal of this disclosure.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
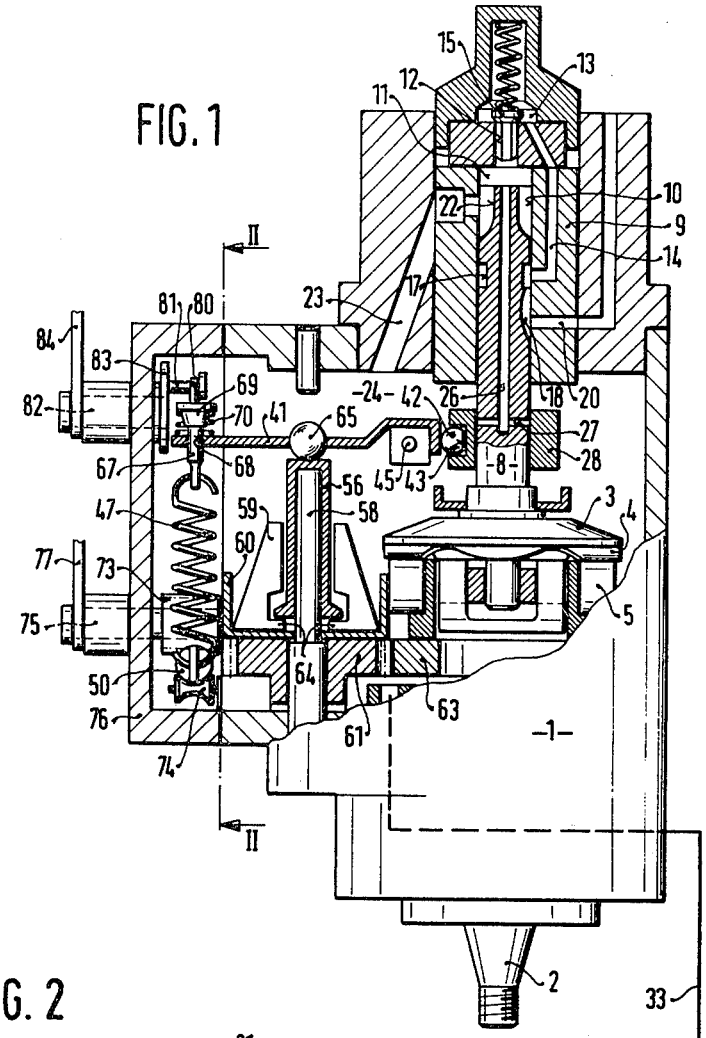
FIG. 1 is a partial cross sectional view taken through a fuel injection pump, the governor of which has a spring construction according to the invention.

Taking as an example a distributor-type pump of known design, the disposition and mode of operation of the rpm governor according to the invention will now be described. A drive shaft 2 is supported in a housing 1 of a fuel injection pump intended for multi-cylinder internal combustion engines. The drive shaft 2 is coupled with a face cam disc 3, which is provided with cams 4 in accordance with the number of cylinders of the engine which are to be supplied with fuel. The cams 4 are moved via stationary rollers 5 as a consequence of the rotation of the drive shaft 2. As a result, a pump piston 8 which is coupled with the face cam disc 3 and pressed onto this disc 3 by means of a spring (not shown) is set into simultaneously reciprocating and rotary movement.

This pump piston 8 operates within a cylinder sleeve 9 inserted into the housing 1 and closed at the top. The cylinder sleeve 9 has a cylinder bore 10 and there encloses a work chamber 11. From the work chamber 11, an axial bore 12 leads into a chamber 13 which communicates via a connecting line 14 with the bore 10 of the cylinder sleeve 9 which feeds fuel into an annular groove 17 in the pump piston 8. The axial bore 12 is closable by means of a valve member 15 urged in the direction of the work chamber 11. In accordance with the rotational movement of the pump piston 8, the connecting line 14 can be made to communicate, via an annular groove 17 on the circumference of the pump piston 8 and a distributor groove 18 communicating with the annular groove 17, sequentially with individual pressure lines 20 discharging into the cylinder bore 10. The pressure lines 20 are distributed uniformly about the cylinder bore 10, corresponding in number to the number of engine cylinders to be supplied, and lead to the injection valves (not shown) of the engine. Upon each compression stroke of the pump piston 8, the fuel is delivered via the axial bore 12, the chamber 13, the connecting line 14, annular groove 17 and the distributor groove 18 to one of the pressure lines 20 only one of which is shown. Upon the intake stroke, the fuel flows out of a suction chamber 24 into the work chamber 11 via a supply line 23, which discharges into the cylinder bore 10, and one of the longitudinal grooves 22 existing on the jacket face of the pump piston 8. Upon the compression stroke of the pump piston 8, communication between the supply line 23 and the longitudinal grooves 22 is interrupted by the piston rotation, so that the full quantity of fuel supplied by the pump piston can be delivered to the pressure lines 20.

In order to regulate the quantity of fuel supplied, the work chamber 11 can be made to communicate with the suction chamber 24 via an axial blind bore 26 in the pump piston 8 and a transverse bore 27 which intersects the blind bore 26. Cooperating with the transverse bore 27 is a fuel quantity adjusting member 28 in the form of a sleeve which can be displaced relative to the pump piston 8 and which by its position determines the instant at which the transverse bore 27 is opened during the upward movement of the pump piston 8 and at which communication is established between the work chamber 11 and the suction chamber 24. From this instant on, the pump supply is interrupted. The quantity of fuel proceeding to injection can thus be determined by adjusting this sleeve 28.

The supply of the suction chamber 24 with fuel is effected by means of a fuel pump 32, which aspirates fuel from a fuel container 31 and pumps it via a feed conduit 33 into the suction chamber 24. In order to obtain an rpm-dependent pressure, a connecting line 34 having a throttle restriction 35 is disposed in the bypass around the fuel pump 32. The size of the throttle restriction is variable by means of a piston 36, which is subjected on its rear side to a spring 37 and to the intake-side fuel pressure ahead of the fuel pump and on its front side to the fuel pressure prevailing in the feed conduit 33.

In order to vary the fuel quantity, the sleeve 28 is adjusted by means of a governor lever 41, which with its ball head 42 engages a recess 43 of the sleeve 28. The governor lever 41 is supported as a fixed swivel point on a shaft 45. The position of this shaft 45 can be varied by means not shown in further detail, for instance by an eccentric element, in order to attain a basic setting. The opposite end of the governor lever 41 is engaged by a bolt 67 that passes through the governor lever 41 to which a governor spring 47 is secured. The other end of the governor spring 47 is secured to a correction lever 50.

The engagement point of a centrifugal governor sleeve 56, which is axially displaceable on a governor shaft 58 by means of flyweights, is located between the fastening point of the governor spring 47 and the shaft 45 so that the governor sleeve engages a ball 65 secured to the lever 41. The flyweights 59 are seated in pockets 60, which are firmly secured to a gear wheel 61, which is seated on the governor shaft 58. The gear wheel 61 is driven by means of a drive gear wheel 63 which is firmly connected to the drive shaft 2, and the flyweights 59 which are carried along by the gear wheel 61 via the pockets 60 are thereby moved radially outward in accordance with the rpm, with their nose-like elements 64 lifting the centrifugal governor sleeve 56. Upon the abutment of the centrifugal governor sleeve 56 on the ball 65 secured to governor lever 41, the rpm-dependent centrifugal force is thus transmitted by lever translation onto the governor lever 41, counter to the force of the governor spring 47. In order that the distance between the engagement point of the centrifugal force transmitted by the governor sleeve and the swivel point 45 will always remain the same, a ball 65 is pressed into the governor lever 41 at this location, or a spherical end of the governor sleeve 56 presses against a flat face of the governor sleeve 41.

As soon as the right-hand-rotational moment exerted on the governor lever 41 by the centrifugal force is greater than the left-hand-rotational moment attained by means of the governor spring 47, the spring end of the governor lever 41 is moved upward and the sleeve 28 is moved downward, in the direction of a reduction of fuel injection quantity. This continues until such time as a balance of forces again prevails at the governor lever 41.

Oriented toward the governor lever 41, one end of the governor spring 47 passes through a bolt 67, which passes through an opening 68 of the governor lever 41 and has a head 69 on its other end. A compression spring 70 is disposed between the head 69 and the governor lever 41. In FIG. 1, the rpm governor assumes the starting position, in which the compression spring 70 displaces the end of the governor lever 41 away from the head 69. The result of this action is that the sleeve 28 is displaced upward as far as possible, so that the distance which the pump piston 8 must travel before the transverse bore 27 is opened is relatively long, causing an increased fuel quantity, or starting quantity, to be supplied to the engine. Then as soon as the idling rpm has been attained after starting, the compression spring 70 is compressed because of an upward movement of the governor spring and of the governor lever due to the force of the centrifugal governor sleeve 56. When the idling rpm has been exceeded, the head 69 then abuts the governor lever 41.

Figure 2:
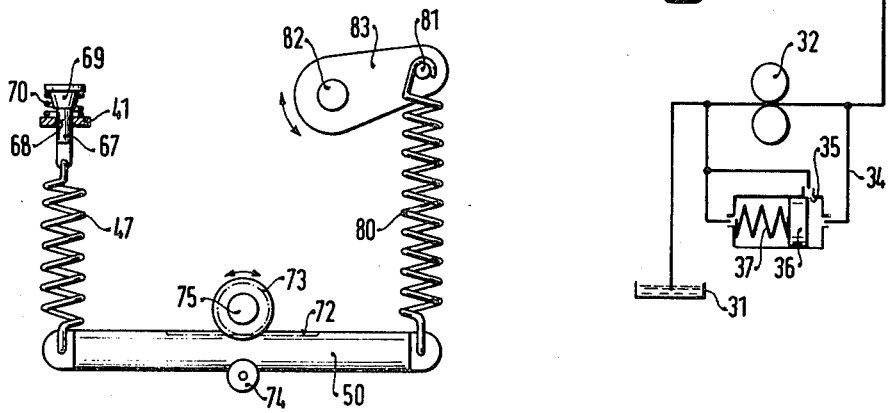
FIG. 2 is a section taken along the line II—II of FIG. 1.

As also shown in FIG. 2, the governor spring 47, with its end remote from the governor lever 41, engages the correction lever 50. The bearing of the correction lever 50 is effected in a rack zone 72 via an adjusting gear wheel 73, opposite which is disposed a roller 74 to serve as a countersupport. The roller 74 is supported by attachment to the housing and is preferably rotatable. As a result of the bearing between the adjusting gear wheel 73 and the roller 74, the correction lever 50 can be displaced in an axial direction by the rotation of the adjusting gear wheel and pivoted about the adjusting gear wheel 73 or the roller 74. The adjusting gear wheel 73 is connected to an actuation shaft 75, which protrudes to the outside through one of the walls (76) of the housing 1 which can comprise a cover means. An actuation lever 77 is connected to the shaft 75 and thus offers an opportunity of engagement once the fuel injection pump has been mounted in place.

One end of a correction spring 80 embodied as a tension spring is connected with the end of the correction lever 50 remote from the governor spring 47, and the other end of the correction spring 80 engages an adjusting bolt 81, which is connected with an adjusting lever 83 such that it is eccentric relative to an adjusting shaft 82. The adjusting shaft 82 is likewise supported in the cover means 76 and carried in a sealing manner toward the outside, as a result of which it is rotatable from outside of the cover means 76 via a lever 84, for instance in order to set the breakaway rpm. The suspension of the governor spring 47 and of the correction spring 80 is effected such that both springs extend virtually parallel to one another. The spring constants of the governor spring 47 and the correction spring 80 may be the same as or different from one another.

In accordance with the invention, with the fuel injection pump in the mounted state, it is possible to displace the correction lever 50 in an axial direction by rotating the adjusting gear wheel 73 via the actuation lever 77, in order to establish the desired degree of proportionality. Thus by varying the respective lever arms associated with two springs 47, 80, a resultant force or a resultant spring constant is produced which engages the governor lever 41 via the governor spring 47 and which corresponds to the desired degree of proportionality. Obviously, movement of the correction lever 50 in an axial direction so that the adjusting gear wheel 73 is off-center along the length of the correction lever 50 will increase or decrease the force of the spring 47 depending on the direction of movement of the adjusting gear wheel.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An rpm governor of a fuel injection pump for internal combustion engines having a governor lever which is pivotable about a shaft and arranged at one end to actuate a supply quantity adjusting member of the fuel injection pump, a governor spring, said governor lever being actuated at another end counter to an rpm-dependent force by said governor spring connected thereto by an upper end thereof, a correction lever, said governor spring further includes a lower end which engages one end portion of said correction lever, a correction spring, said correction spring including one end that is connected to another end of said correction lever, said correction spring having another end connected to an arbitrarily adjusting setting lever, a bearing means provided between opposite ends of said correction lever, said correction lever being supported by and pivotable about a fulcrum point formed by said bearing means, said correction lever being displaceable along its length with respect to said bearing means thereby changing a length of said correction lever between said fulcrum point and said governor spring whereby an rpm force on said governor lever is changed for adjustment of said supply quantity adjusting member.

2. An rpm governor as defined in claim 1, in which said bearing means further includes a drive means which engage complemental means on said correction lever for moving said correction lever relative to said bearing means.

3. An rpm governor as defined by claim 1, in which said bearing means includes an adjusting gear wheel drive.

4. An rpm governor as defined by claim 3 in which said bearing means comprises a countersupport.

5. An rpm governor as defined by claim 4, in which said countersupport comprises a roller.

6. An rpm governor as defined by claim 3, wherein said upper adjusting gear includes a corresponding rack on the surface of said correction lever.

7. An rpm governor as defined in claim 6 which includes an adjusting means for driving said adjusting gear.

8. An rpm governor as defined in claim 1 which includes an adjusting means for adjusting said adjusting setting lever.

9. An rpm governor as defined in claim 7 which includes an adjusting means for adjusting said adjusting setting lever.

* * * * *